US005137045A

United States Patent [19]

Gerber et al.

[11] Patent Number: 5,137,045

[45] Date of Patent: Aug. 11, 1992

[54] ELECTROMAGNETIC METERING OF MOLTEN METAL

[75] Inventors: Howard L. Gerber, Park Forest; Richard T. Gass, Chicago, both of Ill.

[73] Assignee: Inland Steel Company, Chicago, Ill.

[21] Appl. No.: 785,476

[22] Filed: Oct. 31, 1991

[51] Int. Cl.[5] ..... B22D 37/00

[52] U.S. Cl. ..... 137/13; 137/827; 164/147.1

[58] Field of Search ..... 137/827, 13, 828; 164/147.1, 466, 467, 489, 502

[56] References Cited

U.S. PATENT DOCUMENTS

| | | | |
|---|---|---|---|
| 4,020,890 | 5/1977 | Olsson | 164/49 |
| 4,082,207 | 4/1978 | Garnier | 137/827 X |
| 4,173,299 | 11/1979 | Kollberg | 137/827 X |
| 4,324,266 | 4/1982 | Garnier et al. | 137/13 |
| 4,655,237 | 4/1987 | Gloor | 137/827 X |
| 4,805,669 | 2/1989 | Lillicrap | 137/827 |
| 4,842,170 | 6/1989 | Del Vecchio et al. | 222/594 |
| 4,947,895 | 8/1990 | Lillicrap | 137/827 X |

FOREIGN PATENT DOCUMENTS 2204516A 11/1988 United Kingdom .
2204517A 11/1988 United Kingdom .

OTHER PUBLICATIONS

D. C. Lillicrap, "Liquid Metal Flow Control Using AC Fields", *Symposium on Liquid Metal MHD*, Riga, USSR, May 16–20, 1988.

M. Garnier, "Electromagnetic Devices for Molten Metal Confinement", *Third International Seminar in the MHD Flows and Turbulence Series*, Beer-Sheva, Israel, 1983, pp. 433–441.

J. D. Lavers, "An Analysis of an Electromagnetic Mold for the Continuous Casting of Nonferrous Metals", *IEEE Trans. on Ind. Appl.*, vol. 1A-17, 1981, pp. 427–432.

P. G. Simpson, *Induction Heating Coil and System Design*, McGraw-Hill, N.Y. 1960, pp. 4–29; pp. 112–117; pp. 124–129.

Garnier and Moreau, "Stability of Molten Metal Free Surface in the Presence of an Alternating Magnetic Field", *Proc. of IUTAM Symp. on Met. Appl. of MHD*, Cambridge, Sep. 6–10, 1982, pp. 211–216.

*Primary Examiner*—Alan Cohan

*Attorney, Agent, or Firm*—Marshall, O'Toole, Gerstein, Murray & Bicknell

[57] ABSTRACT

A descending stream of molten metal is electromagnetically metered by a primary coil surrounding an upstream portion of the stream. Alternating electric current flows through the coil, and the frequency of that current is controlled to optimize the electromagnetic efficiency (magnetic pressure/power loss) of the electromagnetic metering system. Direct current can be added to the alternating current to also optimize electromagnetic efficiency.

27 Claims, 3 Drawing Sheets

ELECTROMAGNETIC METERING OF MOLTEN METAL

BACKGROUND OF THE INVENTION

The present invention relates generally to metering or controlling the flow rate of a descending molten metal stream and more particularly to the electromagnetic metering of such a stream.

Descending molten metal streams are employed in metallurgical processes such as the continuous casting of steel. In continuous casting, a stream of molten metal descends from an upper container, such as a ladle or a tundish, into a lower casting mold. The rate of flow of the descending molten metal stream has been conventionally controlled or metered by refractory mechanical devices such as refractory metering nozzles, refractory stopper rods or refractory sliding gates. All of these mechanical devices have a tendency to plug when refractory particles, suspended in the molten metal at a location upstream of the metering device, adhere to the refractory walls of the metering device, reducing the flow of the molten metal through the metering device.

Electromagnetic forces have been used in known metering systems to control the flow of a descending stream of molten metal in order to minimize or eliminate the above-described problems which arise when employing mechanical metering devices. In such systems, the stream of molten metal is surrounded by a primary coaxial coil of electrically conductive material, and an alternating electric current is flowed through the primary coil which generates a magnetic field which in turn induces eddy currents in the descending stream of molten metal. The net result of all of this is the production of a magnetic pressure which pinches or constricts the molten metal stream, reducing its cross-sectional area either at the coil or therebelow, depending upon whether the magnetic pressure is greater or less than the pressure head due to the stream.

More particularly, when the magnetic pressure is less than the pressure head due to the stream, the velocity of the descending stream, within the region of the magnetic field (hereinafter referred to as an upstream portion of the stream), is reduced by the magnetic pressure; however, the cross-sectional area of the stream is not reduced at its upstream portion. At that portion of the descending stream which is downstream of the magnetic field (hereinafter referred to as the downstream portion of the stream), there is no substantial magnetic pressure, the velocity of the downstream portion increases, and the stream there undergoes a constriction in its cross-sectional area to maintain a volume flow rate in the downstream portion equal to the volume flow rate in the upstream portion.

If the magnetic pressure exceeds the pressure due to the stream head, the stream will undergo a constriction in cross-sectional area in the region of the magnetic field (the stream's upstream portion). This is because so-called rotational flow occurs in the region of the magnetic field when the magnetic pressure exceeds the pressure head due to the stream. More particularly, stream flow in the center of the stream is in an upstream direction, while stream flow at the periphery of the stream is in a down stream direction; and the net flow in a downstream direction will appear as a constriction in the stream's cross-sectional area beginning in the region of the magnetic field (the stream's upstream portion).

It is desirable to operate the electromagnetic metering system under conditions of optimum electromagnetic efficiency. That efficiency is optimized when the magnetic pressure is relatively high and the power loss in the system is relatively low. Power losses occur in the primary coil which surrounds the descending stream of molten metal and in the stream of molten metal itself. Power losses are manifest as heat in both the primary coil and in the molten metal stream. Power loss in the primary coil is the limiting factor in determining the maximum available current and the generated magnetic field. Also, power loss in the molten metal may raise the temperature of the molten metal stream beyond tolerable limits.

The heat in the coil resulting from power loss there can be dissipated by cooling the coil with a circulating cooling fluid, but, as a practical matter, there is a limit to the amount of heat which can be carried away from the coil by cooling fluid. Overheating of the coil due to excessive power loss is intolerable.

SUMMARY OF THE INVENTION

In accordance with the present invention, an electromagnetic metering system is operated in a manner which optimizes the electromagnetic efficiency of the system. An operating method in accordance with the present invention can consistently optimize the ratio of (a) magnetic pressure to (b) power loss (in the primary coil and the molten metal stream).

In one aspect of the invention, for a given amount of current in the primary coil, magnetic pressure and power loss are both dependent upon the frequency of the current flowing through the primary coil. More particularly, an increase in frequency produces an increase in the induced current in the molten metal which in turn produces an increase in magnetic pressure, up to a certain frequency. Thereafter, any further increase in frequency results in a leveling off, i.e. no further increase, in magnetic pressure.

Where a coaxial coil (1) surrounds a substantially cylindrical, descending metal stream and (2) has a coil radius that exceeds the depth of penetration of the magnetic field into the molten metal (skin depth), power loss in the coil is directly proportional to the square root of the frequency. Similarly, the power loss in the molten metal stream is proportional to the square root of the frequency, where the descending metal stream is substantially cylindrical and has a radius that is greater than the penetration of the magnetic field into the molten metal (skin depth). Skin depth is inversely proportional to the square root of frequency.

Given the foregoing considerations, there is an optimum frequency at which the efficiency of the electromagnetic metering system can be optimized. This frequency varies with the radius of the molten metal stream so that the effect of frequency on electromagnetic efficiency can be more universally expressed in the context of the ratio of stream radius to skin depth.

In accordance with the present invention, it has been determined that electromagnetic efficiency is optimized when the ratio of stream radius to skin depth is in the range of about 1.8 to about 3 for a device which is supplied with alternating current only. Alternately expressed, this means that one should employ a current frequency in the primary coil that produces a skin depth which is greater than about 0.33 and less than about 0.56 of the radius of the unconstricted molten metal stream when only alternating current is supplied to the primary coil.

Electromagnetic efficiency may also be optimized by supplying the primary coil which surrounds the stream of molten metal with direct current in addition to alternating current. Optimization is effected by properly selecting the frequency of the alternating current and by properly selecting the ratio of direct current to alternating current based upon the maximization of the ratio of magnetic pressure to coil loss for both the alternating current and direct current components. In the case where alternating current and direct current are combined, it has been determined that electromagnetic efficiency is optimized when the ratio of stream radius to skin depth is in the range of about 1.0 to about 1.8. Alternately expressed, this means that one should employ a current frequency and a mix of alternating current and direct current in the primary coil that produces a skin depth which is greater than about 0.60 and less than about 0.90 of the radius of the unconstricted molten metal stream.

Other features and advantages are inherent in the method claimed and disclosed or will become apparent to those skilled in the art from the following detailed description in conjunction with the accompanying diagrammatic drawing.

DETAILED DESCRIPTION

Optimization, as herein defined, results from optimum selection of one or more parameters and, when two or more parameters are optimized, they must be optimized in conjunction with each other. For example, the frequency (as one parameter) of the alternating current supplied to the primary coil can be optimized to result in a first optimization of electromagnetic efficiency. Also, direct current (as another parameter) can be added to the alternating current supplied to the primary coil to result in new optimization conditions for the electromagnetic efficiency. When a direct current is supplied to the primary coil and is added to an alternating current, the combination is optimized so that it will result in a still greater electromagnetic efficiency.

Figure 1:
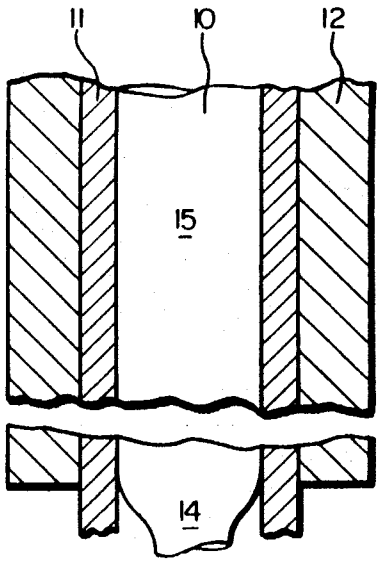
FIG. 1 is a vertical cross-sectional view of an electromagnetic metering device.

Referring initially to FIG. 1, there is shown a substantially cylindrical, descending molten metal stream 10 flowing through a refractory tube 11 surrounded by a coaxial, primary coil 12 composed of electrically conductive material, such as copper. An alternating current of electricity is flowed through coil 12 to produce a mainly axial magnetic field which induces an electric current in stream 10. The net result is to produce a magnetic pressure which constricts molten metal stream 10 to a relative diameter less than that shown in FIG. 1 at 15.

The following discussion assumes a situation in which the pressure head due to the stream exceeds the magnetic pressure which can be developed by coil 12. In such a case, the constriction of stream 10 will occur at stream portion 14, downstream of the region 15 of the magnetic field generated by coil 12. The stream's upstream portion (region 15) has an axial or vertical length corresponding to the axial length of coil 12. The stream's downstream portion 14 begins where coil 12 and upstream portion 15 end.

The constriction at the stream's downstream portion 14 is due to a decrease in stream velocity at the stream's upstream portion 15 (the region of the magnetic field) followed by an increase in stream velocity at downstream portion 14. Because the volume of flow at downstream portion 14 has to be the same as the volume of flow at upstream portion 15, the stream undergoes a constriction in its cross-sectional area at downstream portion 14 to accommodate the increased velocity at 14.

The extent of the constriction depends upon the magnetic pressure. The magnetic pressure for the AC only case is proportional to the square of the current ($I^2$) which flows through coil 12, and for a given current, the magnetic pressure increases with increased frequency of the alternating current flowing through coil 12 up to a certain frequency, which varies with the diameter of molten metal stream 10, after which the magnetic pressure levels off with increasing frequency.

The depth of penetration of the magnetic field, produced by coil 12, into molten metal stream 10 at upstream portion 15 is called skin depth, and skin depth is inversely proportional to the square root of frequency.

There is a power loss in coil 12 as current flows through the coil, and this power loss is manifest as heat, producing a temperature increase in coil 12. For a given current, power loss in coil 12 is directly proportional to the square root of frequency, in a coil having a radius greater than the skin depth.

When current is induced into upstream portion 15 of molten metal stream 10 by the magnetic field generated by coil 12, there is a power loss in the molten metal stream manifested as heat which increases the temperature of stream 10. For a given current in primary coil 12, power loss in molten metal stream 10 is directly proportional to the square root of frequency, where the radius of stream 10 is greater than the skin depth.

The power loss manifested as heat in coil 12 can be dissipated by cooling the coil with a circulating cooling fluid. The heat is dissipated as increased temperature in the cooling fluid, but as a practical matter, the increase in temperature in the cooling fluid is limited to about 30° C., under typical commercial operating conditions.

As noted above, the magnetic pressure exerted to reduce the velocity of the molten metal stream at upstream portion 15 is proportional to the current induced in upstream portion 15, which in turn is proportional to the square of the current in primary coil 12. For a given current in primary coil 12, the induced current in upstream portion 15 and the magnetic pressure there are each proportional to frequency, up to a certain level of frequency. Thereafter, the increase in induced current, and in magnetic pressure, levels off with increasing frequency. However, power loss in both the primary coil and the stream continues to increase with increasing frequency, in proportion to the square root of the frequency.

Figure 2:
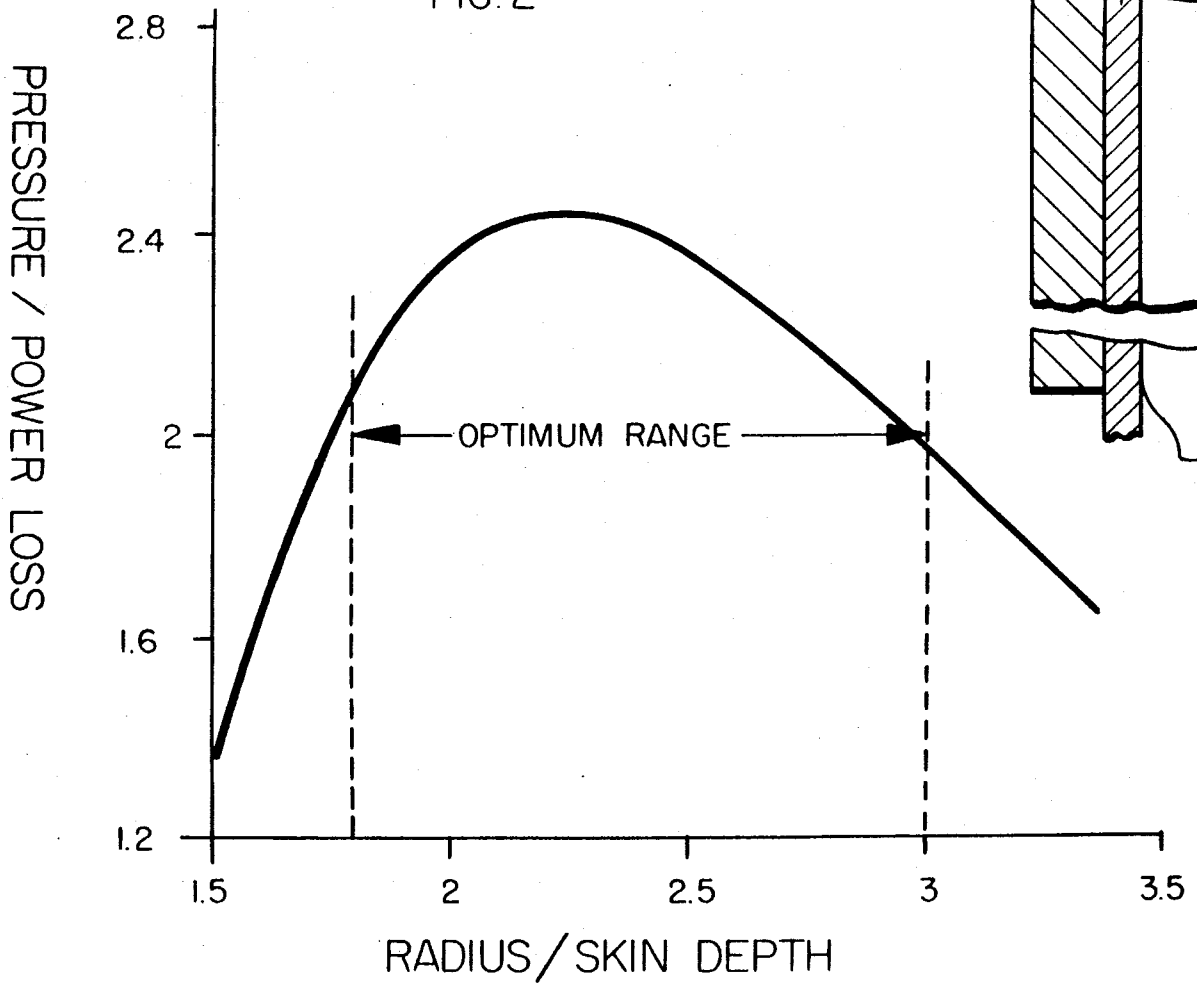
FIG. 2 is a graph depicting electromagnetic efficiency versus the ratio of stream radius to skin depth for an alternating current only device.

The net effect of all the factors discussed in the preceding paragraph is depicted in FIG. 2, for the alternating current only case, in which the ratio of magnetic pressure to power loss is the ordinate (vertical coordinate), and in which the ratio of molten metal stream radius to skin depth is the abscissa (horizontal coordinate). The latter ratio is used as the abscissa, rather than using frequency, because the frequency at which magnetic pressure peaks varies with the radius of the molten metal stream, and the stream radius will vary, from one system to another, with the interior radius of tube 11. Therefore, the effect of frequency on the ratio of magnetic pressure to power loss is more universally depicted by expressing the abscissa as the ratio of stream radius to skin depth.

As noted above, decreasing skin depth reflects increasing frequency. Accordingly, for a given stream radius, an increasing ratio of stream radius to skin depth indicates increasing frequency. In the illustrated embodiment, there is a constant stream radius at upstream portion 15 (within the magnetic field of coil 12) equal to the interior radius of tube 11.

For FIG. 2, magnetic pressure was considered in terms of newtons/m$^2$, and power loss per unit of axial length was considered in terms of watts/m. The area and length dimensions, which enter into a determination of magnetic pressure and power loss for the curve depicted in FIG. 2, are the dimensions of upstream portion 15. Similarly, stream radius is the radius of upstream portion 15, and skin depth is the penetration into upstream portion 15.

As shown in FIG. 2, the ratio of magnetic pressure to power loss (electromagnetic efficiency) initially increases with an increase in the ratio of stream radius to skin depth (reflecting an increase in frequency). Eventually, however, there is a leveling off in the ratio of magnetic pressure to power loss. This leveling off occurs at a ratio of stream radius to skin depth of about 2.2, and it is at that ratio (2.2) where there is an optimized ratio of magnetic pressure to power loss, reflecting an optimized electromagnetic efficiency. (A ratio of stream radius to skin depth of about 2.2 can also be expressed as a skin depth which is about 0.45 of the stream radius.) Increases in the ratio of stream radius to skin depth above 2.2 produces a decrease in the ratio of magnetic pressure to power loss.

There is an optimum range for (a) the ratio of stream radius to skin depth, and this optimum range occurs when (b) the ratio of magnetic pressure to power loss exceeds 2. The optimum range for (a) the ratio of stream radius to skin depth is about 1.8 to about 3. Expressed in another way, the maximum ratio of magnetic pressure to power loss can be obtained by employing a current frequency which produces a skin depth which is greater than 0.33 and less than 0.56 of the stream radius.

In summary, the optimum range for the ratio of stream radius to skin depth (1.8–3), using only alternating current, produces a desired ratio of magnetic pressure to power loss, the latter ratio being in the range 2.0–2.2.

As used in the foregoing discussion, "stream radius" refers to the radius of the unconstricted molten metal stream at upstream portion 15, and "power loss" refers to power loss in both coil 12 and stream 10.

Coil 12 may be in the form of a single turn which is coaxial with molten metal stream 10, or coil 12 may be in the form of a plurality of turns, each coaxial with stream 10. Coil 12 is composed of a material which is highly conductive to electrical current, such as copper or copper alloy. Coil 12 may have a tubular cross-section to permit the circulation of a cooling fluid through the coil. In another embodiment, coil 12 may be made from a solid piece of copper having a surface on which is machined grooves or channels for accommodating the passage of a cooling fluid. A copper cover can be silver soldered onto the coil over the channels to contain the cooling fluid.

The cooling fluid may be high purity, low conductivity water. Refractory tube 11 may be composed of any conventional refractory material heretofore utilized for refractory tubes through which a molten metal stream is flowed. Refractory tube 11 is transparent to the magnetic field generated by coil 12.

At the optimum frequency, the maximum induced magnetic pressure is achieved for a prescribed primary coil loss; that is, the ratio of magnetic pressure to power loss can be optimized by properly selecting the frequency of the alternating current supplied to the primary coil. The primary coil loss is limited by the maximum heat that can be carried away by a heat sink such as circulating cooling water.

Even at the optimum frequency, the maximum ferrostatic head is limited because of the skin effect in the primary coil. As a result of this skin effect, the alternating current supplied to the primary coil flows on the surface of the coil conductor and is confined to a skin depth given by $$\delta=(2/\omega\mu\sigma)^{\frac{1}{2}} \quad (1)$$

where $\omega$ is the angular frequency, $\mu$ is the permeability of free space, and $\sigma$ is the conductivity of the coil material. If direct currents ($\omega=0$) can be used to induce magnetic pressures, the primary current flow would spread throughout the entire dimensions of the conductor. The increased cross section for the primary current flow decreases the power loss and heating of the primary coil and enhances the use of liquid cooling channels. Accordingly, the addition of direct current to an alternating current can also be used to optimize this ratio of magnetic pressure to power loss.

Figure 3:
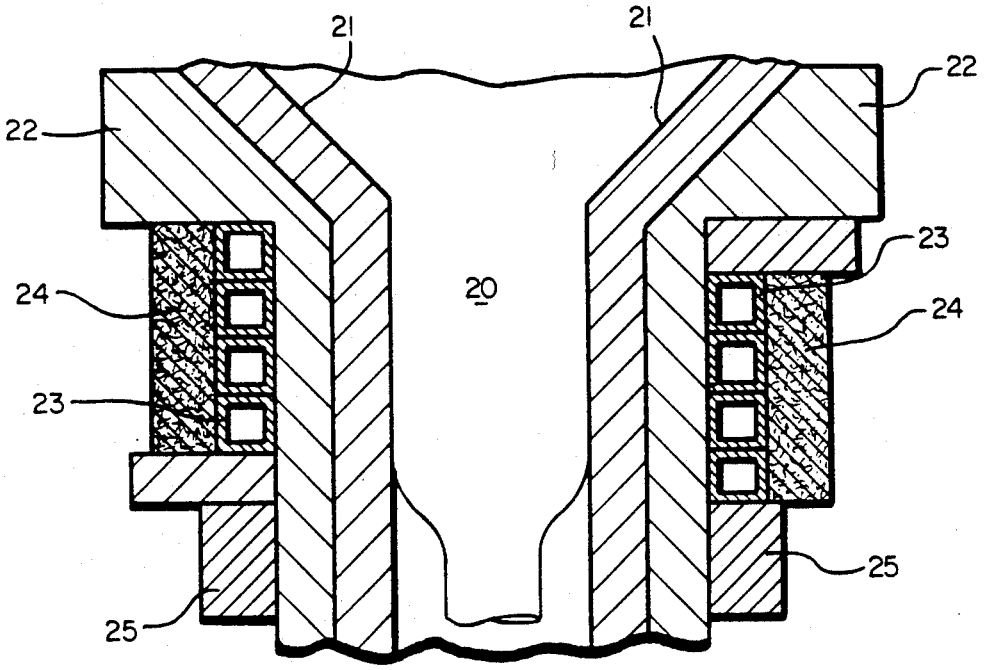
FIG. 3 is a more detailed cross sectional view of an electromagnetic metering device.

As shown in FIG. 3, molten metal stream 20 flows down through a refractory funnel and tube 21 surrounded by refractory insulation 22. A multiturn coaxial primary coil 23 surrounds at least a portion of refractory funnel and tube 21 and refractory insulation 22. As shown, primary coil 23 is comprised of turns of hollow, rectangular copper wiring through which cooling water may be flowed in order to maintain coil 23 within tolerable temperature limits. Coil 23 is surrounded by magnetic material 24, and a ferrite cylinder 25 surrounds refractory funnel and tube 21 and refractory insulation 22 at the lower end of coil 23.

Figure 4:
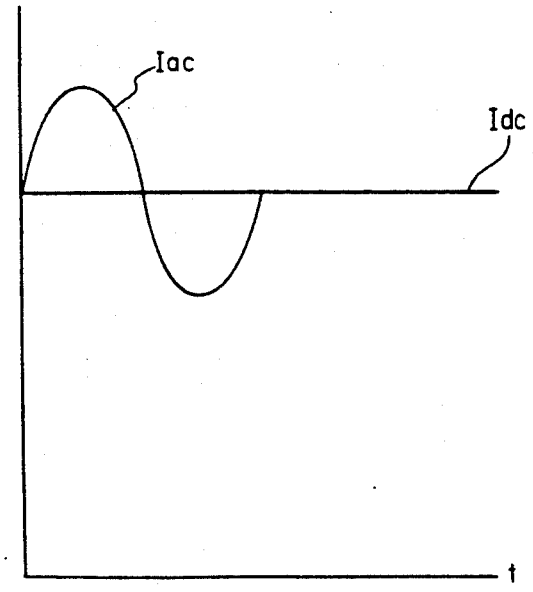
FIG. 4 illustrates the current waveforms for the combination of alternating current and direct current supplied to the primary coil of the devices shown in FIGS. 1 and 3.

As shown in FIG. 4, an electric current comprising both alternating current and direct current can be supplied to primary coil 23. In addition, the frequency of the alternating current may be selected as described above in order to also optimize the magnetic pressure to power loss ratio; however, the use of a direct current in addition to alternating current will enhance this ratio whether or not an optimize current frequency for the alternating current is also employed.

Figure 5:
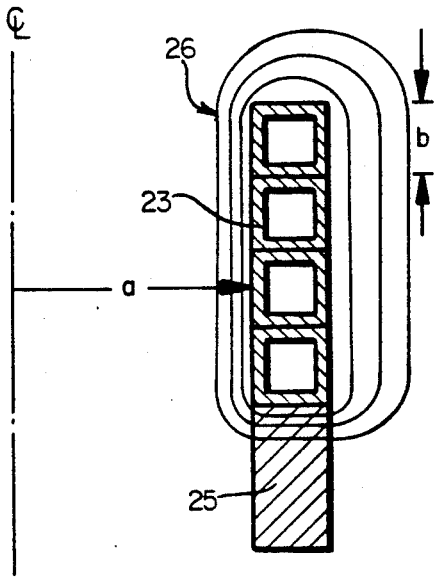
FIG. 5 shows the flux lines produced by the current supplied to the primary coil surrounding the molten metal stream; and, FIG. 6 is a partial cross sectional view of an alternative coil and cooling arrangement for the metering system of the present invention which could be used with a combination of direct current and alternating current.

The estimated magnetic field pattern produced by the combination of alternating current and direct current supplied to coil 23 is shown in FIG. 5. For purposes of clarity, the molten stream and refractory material are not shown in FIG. 5. The presence of the ferrite cylinder 25 produces an abrupt change in magnetic field strength at the lower end of coaxial primary coil 23. Above the ferrite cylinder 25, the magnetic field 26 extends in the shown axial direction and is confined to the skin depth of the molten metal stream (not shown). At the top of ferrite cylinder 25, magnetic field 26 turns horizontally into the ferrite cylinder producing a region below which there is no field. The horizontal field is confined to the upper portion of the ferrite cylinder because the ferrite cylinder offers a path of least reluctance to the magnetic field.

In the region with the axial electromagnetic field, radial body forces are exerted which add together over the radius of the molten metal stream to produce a magnetic pressure. The magnetic pressure opposes the head pressure to decrease the stream velocity according to Bernoulli's theorem. In the region just below the magnetic field, the abrupt lack of magnetic pressure causes the velocity, as discussed above, to revert to its previous higher value (neglecting the change in head at that point). The increase in velocity, according to the mass continuity equation, produces a contraction in diameter thus throttling the molten stream. The magnitude of the throttling effect is determined from the volumetric flow which is the product of decreased cross-sectional area and velocity.

The magnetic pressure, which decreases the velocity of the molten metal stream, is determined by the summation of induced body forces in the molten stream which is given by $$f = JXB \tag{2}$$

where J is the induced current density vector, B is the magnetic flux density vector, and X is the cross product symbol. The AC (i. e. alternating current) and DC (i. e. direct current) components of the coil current produce corresponding magnetic fields $B_{ac}$ and $B_{dc}$ at the surface of the molten stream where $B_{ac}$ is approximately equal to $\mu I_{ac}/b$, $B_{dc}$ is approximately equal to $\mu I_{dc}/b$, and b is the axial length of one turn of the primary coil as shown in FIG. 5.

The AC component of the field is a function of radius whereas the DC component is almost constant with radius (the DC component is a function of coil geometry). The total field in the molten stream is given by $$B = B_{ac}(ber\alpha R + jbei\alpha R)/(ber\alpha + bei\alpha) + B_{dc} \tag{3}$$

where $\alpha$ equals $1.414a/\delta$, ber and bei are Kelvin functions, a is the radius of the molten metal stream, and R is the normalized radial variable whose value is between 0 and 1. The Kelvin functions are traditionally defined as modified Bessel functions according to the following equation:

$$berx + jbeix = J_o(xj^{1.5}) \tag{4}$$

where j in the argument is equal to $(-1)^{0.5}$ and $J_o$ is the Bessel function of the first kind. Alternatively, berx can be determined from the following infinite series:

$$berx = 1 - \frac{(\frac{1}{2}x)^4}{(2!)} + \frac{(\frac{1}{2}x)^8}{(4!)^2} - \ldots; \tag{5}$$

and bei can be determined from the following infinite series:

$$beix = \frac{(\frac{1}{2}X)^2}{(1!)^2} - \frac{(\frac{1}{2}X)^6}{(3!)^2} + \frac{(\frac{1}{2}X)^{10}}{(5!)^2} - \ldots \tag{6}$$

There are also look up tables and software programs for determining berx and beix dependent upon x.

The induced current is determined from the derivative of magnetic field with respect to radius which is given by $$J = \frac{dB}{\mu dR}. \tag{7}$$

It can be shown that the instantaneous AC and DC components of the body force are given, respectively, by $$f_{ac} = \alpha B_{ac}^2 G(R)\,[cos(2\omega t + \theta + \Psi) + cos(\theta - \Psi)[/2\mu \tag{8}$$

and $$f_{dc} \alpha B_{ac} B_{dc} K(R)[cos(\omega t + \theta)]/\mu \tag{9}$$

where $$\theta = tan^{-1}(bei'\alpha R/ber'\alpha R) - tan^{-1}(bei\alpha/ber\alpha) \tag{10}$$

and $$\Psi = tan^{-1}(bei\alpha R/ber\alpha R) - tan^{-1}(bei\alpha/ber\alpha) \tag{11}$$

where G(R) and K(R) are functions of radius and bei' and ber' are derivatives of the Kelvin functions. It can be seen that the instantaneous AC body force, resulting from the magnetic field ($B_{ac}$) induced by the alternating current, varies with time between 0 and a maximum value. This AC body force, within the molten metal stream, is always radially inward towards the axis of the molten metal stream. If only AC body forces are used, a pressure is developed by these forces on the molten metal stream against its axis. In contrast, the DC body force (as expressed in equation 9), resulting from the DC component of the primary coil current, varies at half the rate of the AC body force, and the direction of the DC body force within the molten metal stream alternates between radially inward and radially outward. If the DC body force is made much larger than the AC body force, by making the DC component of the primary coil current large as compared to the AC component, the total body force direction will also alternate in direction with time. In this case, if there were no refractory tube wall, the DC body force component within the molten metal stream would average out, over time, to be approximately 0. However, with the tube wall, when the DC body force is directed radially outward, the outward body forces will produce a pressure on the refractory tube wall which will be reflected back against the molten metal stream to decrease the velocity of the stream. When the DC body force is directed radially inward instead of radially outward, this inward DC body force will produce a similar pressure against the molten metal stream.

These pressures acting against the molten metal stream, whether resulting from the electromagnetic field produced solely by alternating current or produced by a combination of alternating current and direct current, is in the form of a pressure wave and is dependent upon the velocity of the pressure wave (velocity of sound) in the molten metal stream. The pressure wave produced by the electromagnetically induced body forces travels at the velocity of sound. The outwardly travelling pressure wave (i.e. the incident wave) is reflected at the tube wall to produce a return wave which adds to the incident wave. The sum of the incident and reflected waves produces what is commonly known as a standing wave. The velocity of sound in liquid metal is high enough so that the return wave reinforces the slowly varying incident wave. The velocity of sound in molten steel is not known. However, the velocity of sound in mercury, which should be similar to that for liquid steel, is 1450 m/s. Using this value, the two-way transit time is 35 microseconds for a one inch radius of the molten metal stream. The frequency of the electromagnetic field (i.e. the frequency of the alternating current in the alternating and direct current case) to produce the ratio $a/\delta=1.33$ is approximately 962 Hz and accordingly the period is 1.04 milliseconds; here, a is stream radius and $\delta$ is skin depth given by equation (1). The ratio of the 1.04 millisecond time period to the 35 microsecond two-way transit time is 29.7, which is a high value but one that ensures the proper operation described herein.

In the alternating current only case, the body force induced in the molten steel is given by equation (2) where J is given by equation (4) or by dH/dR and H is the magnetic field intensity. The magnetic pressure is determined from the following integral:

$$P_m = \int_0^1 f dR = \mu \int_0^1 \frac{dH}{dR} \times H dR. \tag{12}$$

The solution of this integral is $$P_m = \tfrac{1}{2}\mu(H_a^2 - H_o^2) \tag{13}$$

where $H_a$ is the applied AC magnetic field intensity at $R=1$, and $H_o$ is the magnetic field intensity at the axis of the stream. $H_a$ and $H_o$ are related by the Kelvin functions given by the following expression:

$$H_a = H_o(ber\alpha + jbei\alpha). \tag{14}$$

The primary coil loss is proportional to the parameter $\alpha$ and the applied field squared, and is given by $$P_c = k\alpha H_a^2 \tag{15}$$

where k is a constant that is dependent upon the dimensions and conductivity of the coil. By substituting equation (14) into equations (13) and (15) and by then dividing equation (13) by equation (15), the ratio of $P_m$ to $P_c$ is:

$$\frac{P_m}{P_c} = k_1\Gamma_1(\alpha) \tag{16}$$

where $k_1$ is a proportionality constant dependent upon the proximity of the coil to the molten stream and upon the length of the coil and where $$\Gamma_1(\alpha) = \frac{ber^2\alpha - 1 + bei^2\alpha}{\alpha(ber^2\alpha + bei^2\alpha)}. \tag{17}$$

The ratio given by equation 17, and thus the ratio of $P_m$ (magnetic pressure) to $P_c$ (power loss) given by equation 16, is maximum where $\alpha=3.15$ ($a/\delta=2.23$). In the alternating current case only, $\Gamma_1(\alpha)$ is maximum in the range of 0.2 to 0.24. Thus, since $\delta$ is a function of frequency, the frequency which produces this maximum efficiency can be determined therefrom.

By contrast, in the case where alternating current and direct current are combined and where the direct current component is much larger than the alternating current component, the magnetic pressure is given by $$P_m = \mu(H_a - H_o)H_{dc} \tag{18}$$

where $H_{dc}$ is the DC component of the magnetic field intensity. Again, by substituting equation (14) into equations (18) and (15) and by then dividing equation (18) by equation (15), the ratio of $P_m$ to $P_c$ is:

$$\frac{P_m}{P_c} = k_2\Gamma_2(\alpha) \tag{19}$$

where $k_2$ is again the proportionality constant dependent upon the proximity of the coil to the molten stream and upon the length of the coil and where $$\Gamma_1(\alpha) = \frac{\sqrt{(ber\alpha - 1)^2 + bei^2\alpha}}{\alpha(ber^2\alpha + bei^2\alpha)}. \tag{20}$$

The ratio given by equation 20, and thus the ratio of $P_m$ (magnetic pressure) to $P_c$ (power loss) given by equation 19, is maximum where $\alpha=1.88$ ($a/\delta=1.33$). In the alternating current and direct current case, $\Gamma_2(\alpha)$ is maximum in the range of 0.3 to 0.4.

Accordingly, the optimum frequency is determined from the ratio $a/\delta=2.2$ when using alternating current alone, and $a/\delta=1.3$ when using alternating current and direct current together.

In optimizing the ratio of direct current to alternating current, the exact benefit of using a DC component in addition to alternating current is dependent upon the dimensions of the molten stream. As an example, a coil made from a hollow copper wire having a square cross-section as shown in FIGS. 3 and 5 may be formed. If the wire has dimensions of 0.375 inch on a side and a wall thickness of 0.0625 inch, if the diameter of the molten steel is 0.625 inch, if only alternating current is supplied to the coil, and if a frequency for the alternating current is chosen to produce a skin depth in the molten metal stream equal to 0.142 inch (considering $a/\delta=2.2$ for optimum results), then corresponding skin depth in the copper of the coil will be 0.016 inch. For purposes of this example, it is assumed that water flows through the coil at the rate of 30 liters per minute and allows a tolerable temperature rise of 20° C. With these assumptions, the maximum allowable power dissipation in the coil is 40 kw. From the skin depth, the resistance to alternating current can be determined. From this resistance and from the given acceptable power loss, the maximum current can be determined. Thus, given the above assumptions in dimensions, the resistance $R_{ac}$ is approximately equal to 1 mΩ so that the maximum current that can be used is approximately 6,000 A(rms) and produces an average magnetic pressure equivalent to a ferrostatic head of seven inches.

On the other hand, if a combination of alternating current and direct current is used, the 40 kw power loss may be apportioned equally between the AC and DC components for optimum results. Assuming the same dimensions for the wire and the molten stream, the skin depth in the molten metal stream is now equal to 0.235 inch, the ratio $a/\delta$ is equal to 1.3 for optimum results, and the corresponding skin depth in the copper of the coil will be 0.026 inch. It is again assumed that water flows through the coil at the rate of 30 liters per minute and allows a tolerable temperature rise of 20° C. With these assumptions, the maximum allowable power dissipation in the coil is 40 kw. Again, from the skin depth, the resistance to AC can be determined and, from this resistance and from the given acceptable power loss, the maximum current can be determined. Thus, the resistance to alternating current, $R_{ac}$, is approximately equal to 0.6 mΩ so that, if half the 40 kw power loss is apportioned to the alternating current, the maximum current that can be used is approximately 5,800 A(rms). The resistance to direct current, $R_{dc}$, is approximately equal to 0.13 mΩ. From the 20 kw power loss apportioned to direct current, the direct current is determined to be 12,500 A. The alternating current to direct current ratio accordingly is about 0.46. In this alternating current and direct current case, the magnetic pressure is approximately equivalent to a ferrostatic head of 26 inches which is nearly four times the ferrostatic head resulting from the use of only alternating current having an optimized frequency.

Figure 6:
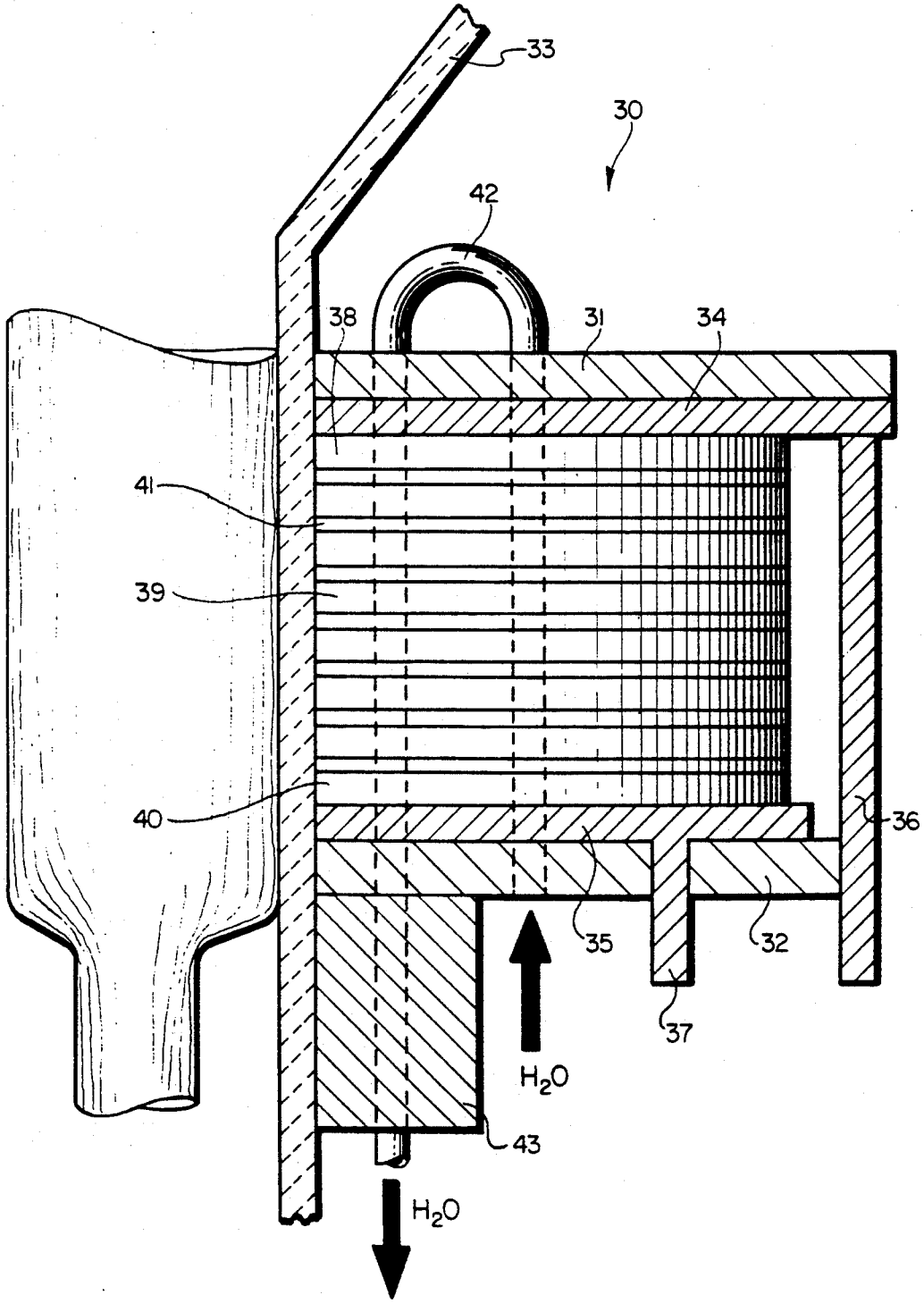

In FIG. 6, a partial cross-sectional view of an alternative coil and cooling arrangement for the metering system of the present invention is shown. Primary electromagnetic coil 30 includes two insulators 31 and 32 coaxially surrounding refractory funnel and tube 33. A molten metal stream flows through refractory funnel and tube 33. Copper backplates 34 and 35, located on the inside surfaces of respective insulators 31 and 32, form contact plates for respective contact tabs 36 and 37. Upper contact plate 34 electrically contacts the upper turn 38 of a helical plate-type coil 39. Helical plate-type coil 39 spirals coaxially down and around refractory funnel and tube 33 and ends with a final turn 40 which electrically contacts copper back plate 35. Adjacent turns of coil 39 are electrically insulated from one another by insulator 41. A plurality of cooling conduits, one of which is shown at 42, are formed through coil 39 in order to absorb the heat generated in coil 39 and carry the heat away to a heat exchanger. Current is supplied to coil 39 by use of tabs 36 and 37 and flows between plates 34 and 35 through coil 39 in order to generate an electromagnetic field for metering the molten metal stream. Ferrite cylinder 43 surrounds refractory funnel and tube 33 and functions in much same way as does ferrite cylinder 25 shown in FIG. 3.

The foregoing detailed description has been given for clearness of understanding only, and no unnecessary limitations should be understood therefrom, as modifications will be obvious to those skilled in the art.

We claim:

1. A method for electromagnetically metering a molten metal stream flowing through a conduit by supplying an electric current through a primary coil wound around said conduit, wherein said electric current through said primary coil (a) results in a power loss in said primary coil and in said molten metal stream and (b) produces a magnetic field creating a magnetic pressure for metering said molten metal stream, said method including:

selecting a parameter for said electric current supplied to said primary coil so as to optimize the ratio of said magnetic pressure to said power loss.

2. The method of claim 1 wherein said electric current is alternating current and wherein said step of selecting said parameter comprises the step of selecting a frequency for said alternating current so as to optimize said ratio of said magnetic pressure to said power loss.

3. The method of claim 2 wherein said molten metal stream has an unconstricted radius, wherein said magnetic pressure meters said molten metal stream by constricting said unconstricted radius for said molten metal stream to a constricted radius, and wherein said step of selecting said frequency for said alternating current comprises the step of selecting a frequency for said alternating current supplied to said primary coil that produces a penetration by said magnetic field into said molten metal stream (i.e. skin depth) which is greater than about 0.33 and less than about 0.56 of said unconstricted radius of said molten metal stream.

4. The method of claim 3 wherein said step of selecting a frequency for said alternating current supplied to said primary coil that produces a penetration by said magnetic field into said molten metal stream (i.e. skin depth) which is greater than about 0.33 and less than about 0.56 of said unconstricted radius of said molten metal stream comprises the step of selecting a frequency for said alternating current that produces a skin depth which is about 0.45 of said unconstricted radius.

5. The method of claim 3 wherein said step of selecting a frequency for said alternating current supplied to said primary coil that produces a penetration by said magnetic field into said molten metal stream (i.e. skin depth) which is greater than about 0.33 and less than about 0.56 of said unconstricted radius of said molten metal stream comprises the step of selecting a frequency for said alternating current so that the ratio of said magnetic pressure to said power loss is in the range of 0.2 k–0.24 k where said magnetic pressure is expressed as newtons/$m^2$, said power loss is expressed as watts/m, and k is a proportionality constant dependent upon the proximity of the coil to the molten stream and upon the length of the coil.

6. The method of claim 2 wherein said step of selecting a frequency for said alternating current comprises the step of selecting a frequency for said alternating current so that the ratio of said magnetic pressure to said power loss is in the range of 0.2 k–0.24 k where said magnetic pressure is expressed as newtons/$m^2$, said power loss is expressed as watts/m, and k is a proportionality constant dependent upon the proximity of the coil to the molten stream and upon the length of the coil.

7. The method of claim 1 wherein said step of selecting a parameter for said electric current comprises the step of employing both alternating current and direct current as said electric current.

8. The method of claim 7 wherein said step employing both alternating current and direct current as said electric current comprises the step of selecting a ratio of said alternating current to said direct current so as to optimize said ratio of said magnetic pressure to said power loss.

9. The method of claim 8 wherein said step of selecting a ratio of said alternating current to said direct current so as to optimize the ratio of said magnetic pressure to power loss comprises the step of selecting said ratio of said alternating current to said direct current so as to produce a power loss attributable to said direct current which is approximately equal to power loss attributable to said alternating current.

10. The method of claim 9 wherein said step of selecting said parameter comprises the further step of selecting a frequency for said alternating current so as to optimize said ratio of said magnetic pressure to said power loss based upon frequency selection.

11. The method of claim 10 wherein said molten metal stream has an unconstricted radius, wherein said magnetic pressure meters said molten metal stream by constricting said unconstricted radius of said molten stream to a constricted radius, and wherein said step of selecting said frequency for said alternating current comprises the step of selecting a frequency for said alternating current supplied to said primary coil that produces a penetration by said magnetic field into said molten metal stream (i.e. skin depth) which is greater than about 0.60 and less than about 0.90 of said unconstricted radius of said molten metal stream.

12. The method of claim 11 wherein said step of selecting a frequency for said alternating current supplied to said primary coil that produces a penetration by said magnetic field into said molten metal stream (i.e. skin depth) which is greater than about 0.60 and less than about 0.90 of said unconstricted radius of said molten metal stream comprises the step of selecting a frequency for said alternating current that produces a skin depth which is about 0.75 of said unconstricted radius.

13. The method of claim 11 wherein said step of selecting a frequency for said alternating current supplied to said primary coil that produces a penetration by said magnetic field into said molten metal stream (i.e. skin depth) which is greater than about 0.60 and less than about 0.90 of said unconstricted radius of said molten metal stream comprises the step of selecting a frequency for said alternating current so that the ratio of said magnetic pressure to said power loss is in the range of 0.3 k–0.4 k where said magnetic pressure is expressed as newtons/m$^2$, said power loss is expressed as watts/m, and k is a proportionality constant dependent upon the proximity of the coil to the molten stream and upon the length of the coil.

14. The method of claim 10 wherein said step of selecting a frequency for said alternating current comprises the step of selecting a frequency for said alternating current so that the ratio of said magnetic pressure to said power loss is in the range of 0.3 k–0.4 k where said magnetic pressure is expressed as newtons/m$^2$, said power loss is expressed as watts/m, and k is a proportionality constant dependent upon the proximity of the coil to the molten stream and upon the length of the coil.

15. The method of claim 8 wherein said step of selecting said parameter comprises the further step of selecting a frequency for said alternating current so as to optimize said ratio of said magnetic pressure to said power loss based upon frequency selection.

16. The method of claim 15 wherein said molten metal stream has an unconstricted radius, wherein said magnetic pressure meters said molten metal stream by constricting said unconstricted radius of said molten metal stream to a constricted radius, and wherein said step of selecting said frequency for said alternating current comprises the step of selecting a frequency for said alternating current supplied to said primary coil that produces a penetration by said magnetic field into said molten metal stream (i.e. skin depth) which is greater than about 0.60 and less than about 0.90 of said unconstricted radius of said molten metal stream.

17. The method of claim 16 wherein said step of selecting a frequency for said alternating current supplied to said primary coil that produces a penetration by said magnetic field into said molten metal stream (i.e. skin depth) which is greater than about 0.60 and less than about 0.90 of said unconstricted radius of said molten metal stream comprises the step of selecting a frequency for said alternating current that produces a skin depth which is about 0.75 of said unconstricted radius.

18. The method of claim 16 wherein said step of selecting a frequency for said alternating current supplied to said primary coil that produces a penetration by said magnetic field into said molten metal stream (i.e skin depth) which is greater than about 0.60 and less than about 0.90 of said unconstricted radius of said molten metal stream comprises the step of selecting a frequency for said alternating current so that the ratio of said magnetic pressure to said power loss is in the range of 0.3 k–0.4 k where said magnetic pressure is expressed as newtons/m$^2$, said power loss is expressed as watts/m, and k is a proportionality constant dependent upon the proximity of the coil to the molten stream and upon the length of the coil.

19. The method of claim 15 wherein said step of selecting a frequency for said alternating current comprises the step of selecting a frequency for said alternating current so that the ratio of said magnetic pressure to said power loss is in the range of 0.3 k–0.4 k where said magnetic pressure is expressed as newtons/m$^2$, said power loss is expressed as watts/m, and k is a proportionality constant dependent upon the proximity of the coil to the molten stream and upon the length of the coil.

20. A method for electromagnetically metering a molten metal stream flowing through a conduit by supplying an electric current through a primary coil wound around said conduit, wherein said electric current supplied through said primary coil (a) results in a power loss in said primary coil and in said molten metal stream and (b) produces a magnetic field creating a magnetic pressure for metering said molten metal stream, said method including:

employing both alternating current and direct current as said electric current.

21. The method of claim 20 wherein said step of employing both alternating current and direct current as said electric current comprises the step of selecting a frequency for said alternating current supplied to said primary coil that produces a penetration by said magnetic field into said molten stream (i. e. skin depth) which is greater than about 0.60 and less than about 0.90 of said unconstricted radius of said molten metal stream.

22. The method of claim 21 wherein said step of employing both alternating current and direct current as said electric current comprises the additional step of selecting a ratio of alternating current to direct current so as to optimize the ratio of said magnetic pressure to said power loss in said primary coil and in said molten metal stream.

23. The method of claim 22 wherein said step of selecting said ratio of alternating current to direct current comprises the additional step of selecting said ratio of said alternating current to said direct current so as to produce a power loss attributable to said alternating current approximately equal to a power loss attributable to said direct current.

24. In the electromagnetic metering of a substantially cylindrical, descending molten metal stream having an upstream portion surrounded by a coaxial primary coil of electrically conductive material, wherein an alternating electric current is flowed through said coil to produce a mainly axial magnetic field creating a magnetic pressure for constricting said molten metal stream at a portion thereof downstream of said upstream portion by reducing the velocity of said upstream portion compared to the velocity of said downstream portion, a method of performing said metering so as to provide substantially the maximum ratio of (a) magnetic pressure to (b) power loss (in said primary coil and said molten metal stream), said method comprising:

employing a current frequency in said primary coil that produces a penetration by said magnetic field into said upstream portion of the molten metal stream (skin depth) which is greater than about 0.33 and less than about 0.56 of the radius of said upstream portion.

25. In the metering method recited in claim 24 wherein:

a current frequency is employed that produces a skin depth which is about 0.45 of the radius of said upstream portion.

26. In the metering method recited in claim 24 wherein said primary coil has a single turn or has a plurality of turns, each coaxial with said upstream portion of the molten metal stream.

27. In a metering method as recited in claim 24 wherein:

said ratio of (a) magnetic pressure to (b) power loss (in the primary coil and the molten metal stream) is in the range of 0.2 k–0.24 k where said magnetic pressure is expressed as newtons/$m^2$, said power loss is expressed as watts/m, and k is a proportionality constant dependent upon the proximity of the coil to the molten stream and upon the length of the coil.

* * * * *

UNITED STATES PATENT AND TRADEMARK OFFICE

CERTIFICATE OF CORRECTION

PATENT NO. : 5,137,045

DATED : August 11, 1992

INVENTOR(S) : October 31, 1991

It is certified that error appears in the above-identified patent and that said Letters Patent is hereby corrected as shown below:

Column 8, line 24, change "[/2$\mu$" to -- ]/2$\mu$ --.

Column 8, line 27, change "$f_{dc}\alpha$" to -- $f_{d\bar{c}}\alpha$ --.

Column 10, line 33, change "$\Gamma_1$" to -- $\Gamma_2$ --.

Signed and Sealed this

Seventh Day of December, 1993

*Attest:*

*Attesting Officer*

Bruce Lehman

BRUCE LEHMAN

*Commissioner of Patents and Trademarks*